US010442565B2

(12) United States Patent
Mulvey

(10) Patent No.: US 10,442,565 B2
(45) Date of Patent: Oct. 15, 2019

(54) CHILD RESISTANT PACKAGING

(71) Applicant: Multi Packaging Solutions UK Limited, Nottingham (GB)

(72) Inventor: Robert Mulvey, Leicester (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 246 days.

(21) Appl. No.: 15/599,071

(22) Filed: May 18, 2017

(65) Prior Publication Data

US 2017/0349322 A1 Dec. 7, 2017

(30) Foreign Application Priority Data

Jun. 3, 2016 (GB) ..... 1609773.5

(51) Int. Cl.
*B65D 5/54* (2006.01)
*B65D 5/38* (2006.01)
*B65D 5/42* (2006.01)

(52) U.S. Cl.
CPC ..... *B65D 5/542* (2013.01); *B65D 5/38* (2013.01); *B65D 5/4266* (2013.01); *B65D 2215/02* (2013.01); *B65D 2215/04* (2013.01)

(58) Field of Classification Search
CPC .... B65D 5/38; B65D 5/4266; B65D 2215/02; B65D 2215/04; B65D 5/542; B65D 85/60
(Continued)

(56) References Cited

U.S. PATENT DOCUMENTS 1,943,074 A * 1/1934 Heyman ..... B65D 5/422 229/103.2
2,930,518 A * 3/1960 Cottrill ..... B65D 5/0227 229/185.1

(Continued)

FOREIGN PATENT DOCUMENTS

CN 101607609 12/2009
EP 1048577 A1 11/2000

(Continued)

OTHER PUBLICATIONS

Extended EP Search Report for EP Appln. No. 17171701.0 dated Nov. 23, 2017.

*Primary Examiner* — Chun Hoi Cheung
(74) *Attorney, Agent, or Firm* — O'Shea Getz, P.C.

(57) ABSTRACT

A child resistant package is made from paperboard, cardboard or other foldable sheet material. The package includes an outer sleeve having a closed end and an opposed open end and an inner sleeve, telescopically received within the outer sleeve. The inner sleeve has a closed end adjacent the open end of the outer sleeve. The inner sleeve is joined to the outer sleeve by a frangible connection. The package further includes a selectively releasable lock between the inner sleeve and the outer sleeve for preventing withdrawal of the inner sleeve from the outer sleeve after the frangible connection between the inner sleeve and the outer sleeve has been broken. An opening tab is formed in the outer sleeve and is configured to break the frangible connection between the inner and outer sleeves when the tab is released from the outer sleeve and to provide an opening in the outer sleeve to provide access to the inner sleeve such that the inner sleeve may be pressed inwardly in order to release the releasable lock between the inner and outer sleeves.

23 Claims, 8 Drawing Sheets

(58) Field of Classification Search
USPC ..... 229/913, 125.125, 102; 206/1.5
See application file for complete search history.

(56) References Cited

U.S. PATENT DOCUMENTS

| | | | | | |
|---|---|---|---|---|---|
| 3,065,896 | A * | 11/1962 | Grapp | B65D 5/541 | 229/203 |
| 3,298,596 | A * | 1/1967 | Tolaas | B65D 5/5405 | 229/241 |
| 3,302,844 | A * | 2/1967 | Warren | B65D 5/38 | 229/120.18 |
| 3,708,104 | A * | 1/1973 | Buttery | B65D 5/5007 | 229/208 |
| 4,049,190 | A * | 9/1977 | O'Neill | B65D 5/5435 | 229/149 |
| 4,524,900 | A * | 6/1985 | Salminen | B65D 5/38 | 229/125.125 |
| 4,524,901 | A * | 6/1985 | Tikka | B65D 5/38 | 229/125.125 |
| 7,273,145 | B2 * | 9/2007 | Focke | B65D 5/38 | 206/267 |
| 7,299,968 | B2 * | 11/2007 | Mittmann | B65D 5/38 | 229/125.125 |
| 7,377,385 | B2 * | 5/2008 | Giannini | B65D 5/38 | 206/267 |
| 7,832,624 | B2 * | 11/2010 | Kong | B65D 5/38 | 206/1.5 |
| 8,342,330 | B2 * | 1/2013 | Weston | B65D 83/0463 | 206/531 |
| 8,869,984 | B2 * | 10/2014 | Bellamah | B65D 83/0463 | 206/468 |
| 8,899,414 | B2 * | 12/2014 | Chatelain | B65D 85/1054 | 206/267 |
| 2006/0054673 | A1 | 3/2006 | Mittmann et al. | | |
| 2007/0068843 | A1 | 3/2007 | Hession | | |
| 2010/0108550 | A1 * | 5/2010 | Cesare | B65D 5/38 | 206/362 |
| 2011/0232236 | A1 * | 9/2011 | Chatelain | B65D 85/1054 | 53/452 |
| 2012/0228369 | A1 * | 9/2012 | Aldridge | B65D 5/38 | 229/125 |
| 2015/0307246 | A1 * | 10/2015 | Patwardhan | B65D 55/02 | 206/1.5 |
| 2016/0251107 | A1 * | 9/2016 | Everett | B65D 5/38 | 206/1.5 |

FOREIGN PATENT DOCUMENTS

| | | | |
|---|---|---|---|
| FR | 2785872 | A1 | 5/2000 |
| JP | S53161934 | | 12/1978 |
| JP | 2008143533 | | 6/2008 |
| JP | 2008285176 | | 11/2008 |
| JP | 2014055010 | A | 3/2014 |
| WO | 2012121924 | | 9/2012 |

* cited by examiner

CHILD RESISTANT PACKAGING

This application claims priority to Great Britain Patent Appln. No. GB 1609773.5 filed Jun. 3, 2016, which is herein incorporated by reference

BACKGROUND OF THE INVENTION

1. Technical Field

The present invention relates to packaging, more particularly child resistant packaging, for example for pharmaceutical products.

2. Background Information

Pharmaceutical products are frequently supplied in bottles or tubes. Such containers are frequently supplied in a carton made from a paperboard, cardboard or other foldable sheet material. The cartons typically comprise an opening flap at one end providing access to the container inside the carton. An adhesive sticker may be provided over the flap and an adjacent wall of the carton to provide some level of child resistance to the carton, but after initial opening, this may not provide effective child resistance.

The present invention seeks to provide a package with improved child resistance.

SUMMARY OF THE INVENTION

From a first aspect, the invention provides a child resistant package made from paperboard, cardboard or other foldable sheet material. The package comprises an outer sleeve having a closed end and an opposed open end and an inner sleeve telescopically received within the outer sleeve and having a closed end adjacent the open end of the outer sleeve. The inner sleeve is joined to the outer sleeve by a frangible connection. A selectively releasable lock is provided between the inner sleeve and the outer sleeve for preventing withdrawal of the inner sleeve from the outer sleeve after the frangible connection between the inner sleeve and the outer sleeve has been broken. An opening tab is formed in the outer sleeve and is configured to break the frangible connection between the inner and outer sleeves when the tab is released from the outer sleeve and to provide an opening in the outer sleeve to provide access to the inner sleeve such that the inner sleeve may be pressed inwardly in order to release the releasable lock between the inner and outer sleeves.

Thus in accordance with the invention, an inner sleeve and an outer sleeve are firstly connected by a frangible connection. This must be broken to allow withdrawal of the inner sleeve from the outer sleeve. Moreover, a releasable lock is provided between the inner and outer sleeves. This can only be accessed after the frangible connection is broken. Thus the package comprises at least two levels of child resistance.

The frangible connection between the inner and outer sleeves may comprise one or more lines of weakness defined in a connecting panel which is attached to and arranged between said inner and outer sleeves.

The one or more lines of weakness may define a tab which underlies and which is bonded to the opening tab. Thus when the opening tab is released, it will act to break the connection between two parts of the connecting panel.

The selectively releasable lock may comprise a first locking element formed by a first sub-panel of the connecting panel and attached to said inner sleeve and a second locking element attached to the outer sleeve. The first locking element and the second locking element may comprise opposing, interfering locking edges which engage to prevent withdrawal of the inner sleeve from the outer sleeve. The Inward pressing of the inner sleeve penults disengagement of the locking edges.

The first sub-panel of the connecting panel may be defined by a cut line which longitudinally divides a first end of the connecting panel into the first sub-panel and a second sub-panel for gluing to a wall panel of the outer sleeve.

The second locking element may comprise a flap hingedly attached to the connecting panel at the open end of the outer sleeve and extending into the outer sleeve from the open end of the outer sleeve.

The second locking element flap may be bonded to an opposed sub-panel of the connecting panel.

The flap may have a double thickness locking edge, formed by folding over a distal end of the flap.

The opening tab may be defined as a tear strip extending across a wall of the outer sleeve. The opening tab may be configured to be removed completely from the wall or to remain attached thereto after opening.

The package may further comprise removable tabs at the open end of the outer sleeve. These tabs may have to be removed to allow a user to grip the inner sleeve in order for it to be withdrawn from the outer sleeve. This therefore acts as a further level of child resistance.

The inner sleeve may have an open end adjacent the closed end of the outer sleeve for accessing the contents of the package. To facilitate access to the contents, its open end may be angled.

The child resistant package is preferably made from a one-piece blank of foldable sheet material, and from a further aspect, the invention provides a one piece blank for forming a child resistant package comprising a row of first, second, third and fourth outer sleeve wall panels hingedly connected about first to third parallel hinge lines for forming an outer sleeve of the package. The blank further comprises a row of first, second, third and fourth inner sleeve wall panels hingedly connected about fourth to sixth parallel hinge lines for forming an inner sleeve of the package. The fourth to sixth hinge lines are parallel to the first to third hinge lines. The blank further comprises a connecting panel connected between the first row and second row of panels and hingedly connected to the fourth inner sleeve wall panel about a seventh hinge line which is parallel to the first to sixth hinge lines, and to the fourth outer sleeve wall panel about an eighth hinge line which is parallel to the first to sixth hinge lines. The connecting panel further comprises a flap hingedly connected to an end thereof about a ninth hinge line which is perpendicular to the first to sixth hinge lines. The connecting panel comprises a frangible connection between two parts thereof. The first outer sleeve panel comprises an opening tab defined therein which is aligned with the frangible connection such as to overlie the frangible connection when the blank is erected.

The connecting panel may comprise a first sub panel connected to the fourth inner sleeve wall panel about the seventh hinge line and a third sub-panel connected to the fourth outer sleeve wall panel about the eighth hinge line. The frangible connection may be between the first and third sub-panels.

The frangible connection may comprise a tab or strip defined between lines of weakness formed in the connecting panel.

The connecting panel may further comprise a second sub-panel separated from the first sub-panel by a cut line and hingedly connected to the fourth outer sleeve wall panel about the eighth hinge line.

A frangible bridge of material may be provided between the first and second sub-panels.

The flap may be formed with a distal flap connected to the flap about a tenth hinge line parallel to the ninth hinge line.

The invention also provides a partially erected blank formed from any of the aforementioned blanks. The flap of the connecting panel is folded about the ninth hinge line to overlie the third sub-panel of the connecting panel. An inner shell portion comprises the inner shell wall panels, with the first inner shell wall panel folded about the sixth hinge line to overlie the second inner wall panel, and the second and third inner shell wall panels folded about the fourth hinge line such that the second wall inner sleeve panel overlies the connecting panel and is bonded to the first sub-panel of the connecting panel. The inner sleeve wall panels and the connecting panel are folded about the eighth hinge line to overlie the third and fourth outer sleeve wall panels. An outer shell portion comprises the outer shell wall panels with the first and second outer sleeve wall panels folded about the second hinge line to sandwich the inner sleeve wall panels and connecting panel between the first and second outer sleeve wall panels and the third and fourth outer sleeve wall panels, the first outer sleeve wall panel being bonded to the flap of the connecting panel.

BRIEF DESCRIPTION OF DRAWINGS

An embodiment of the invention will now be described by way of example only with reference to the accompanying drawings in which.

DETAILED DESCRIPTION OF THE INVENTION

Figure 1:
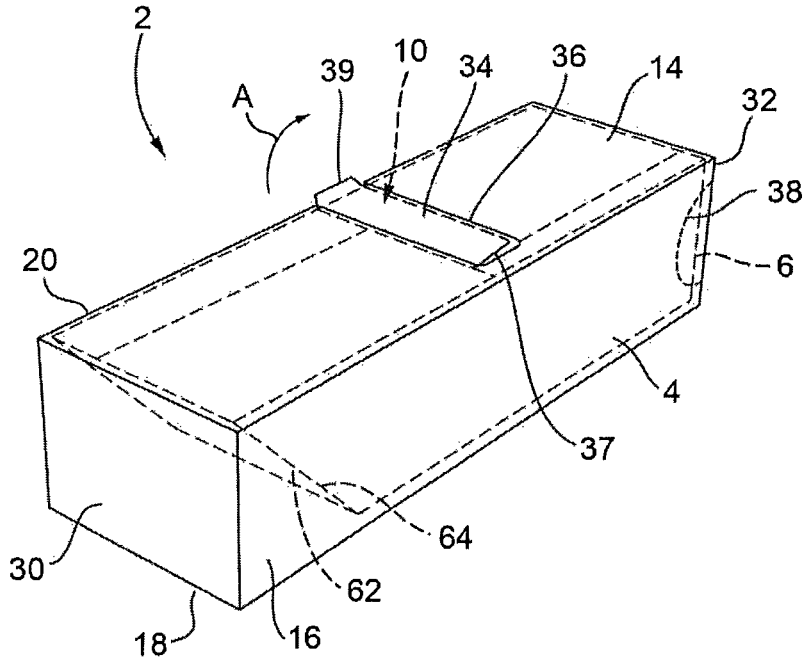
FIG. 1 shows a package in accordance with the invention.
Figure 2:
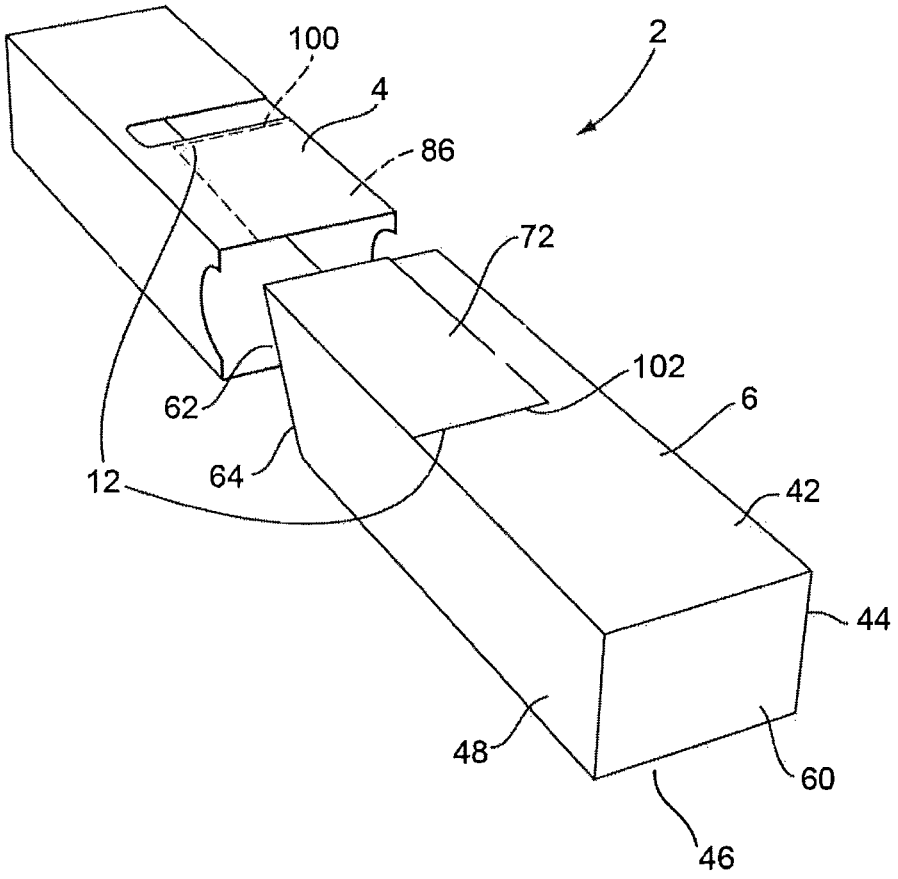
FIG. 2 shows the carton of FIG. 1 in an open configuration.

With reference to FIGS. 1 and 2, a package 2 in accordance with this invention comprises an outer sleeve 4 and an inner sleeve 6 slidably mounted within the outer sleeve.

Figure 3:
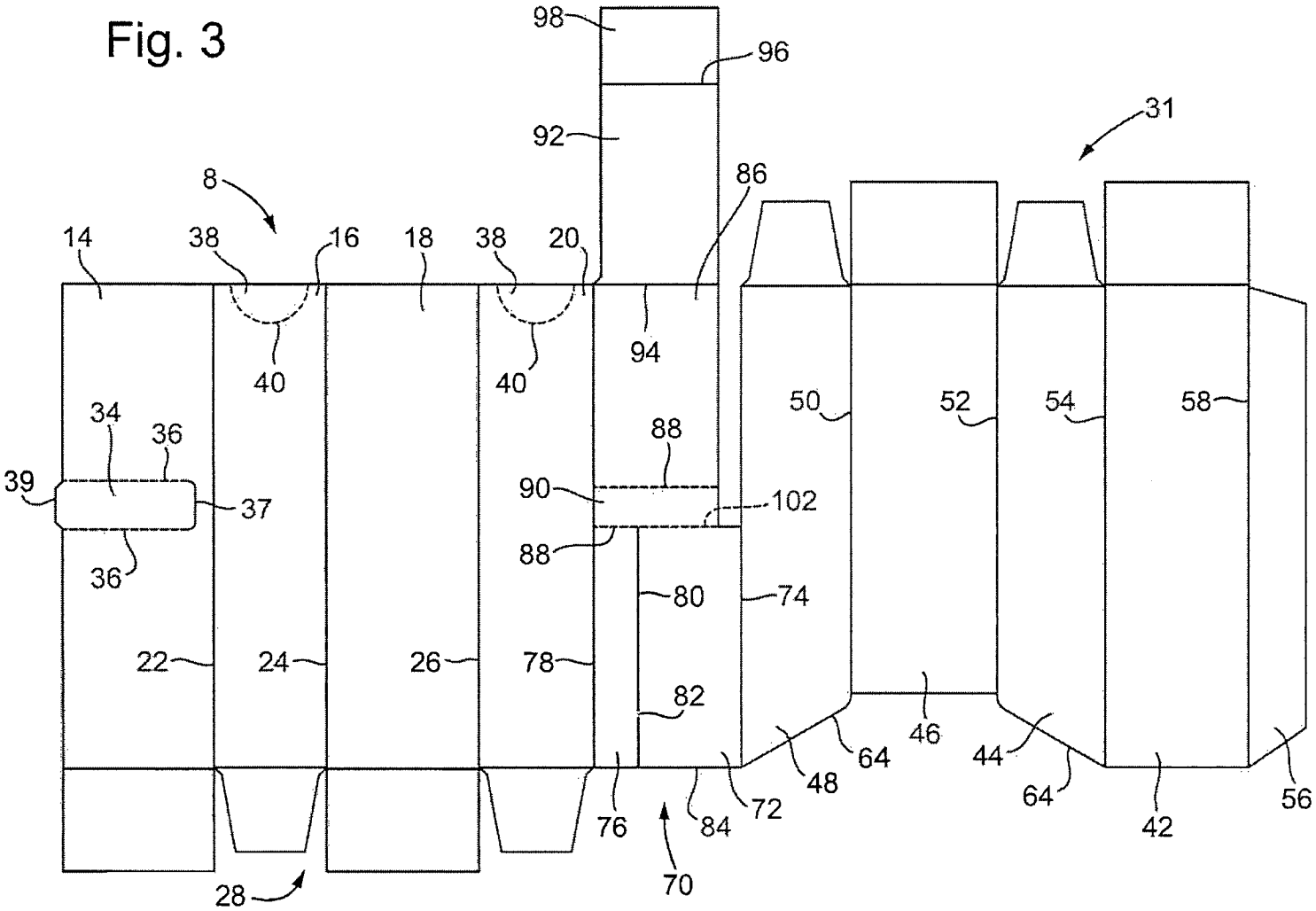
FIG. 3 shows a blank for making a package as illustrated in FIG. 1.

The package 2 is made from a one-piece blank 8 of paperboard, cardboard or other foldable sheet material as illustrated in FIG. 3.

The package 2 is therefore a one-piece construction comprising the outer sleeve 4 and the inner sleeve 6.

To permit access to the package contents, however, a frangible connection 10 is provided between the outer sleeve 4 and the inner sleeve 6. Also, to prevent withdrawal of the inner sleeve 6 from the outer sleeve 4 after the outer sleeve 4 and inner sleeve 6 have been separated, a selectively releasable lock 12 is also provided between the inner and outer sleeves 4, 6. These features will be described further below.

The outer sleeve 4 has first, second, third and fourth outer sleeve wall panels 14, 16, 18, 20. As illustrated in FIG. 3, these outer sleeve panels 14, 16, 18, 20 are arranged in a first array of panels, the panels being hingedly connected about first, second and third parallel hinge lines 22, 24, 26. The first array of panels is provided with an array of end flaps 28 which, in the erected outer sleeve 4, form a closed end 30 of the outer sleeve 4. The opposite end 32 of the outer sleeve 4 is open.

As can be seen in FIGS. 1 and 3, the first wall panel 14 of the outer sleeve 4 comprises an opening tab 34 defined by lines of weakness 36. The lines of weakness 36 may, as illustrated, extend only partly around the opening tab 34, leaving a hinge 37 at one end of the tab 34. In other embodiments, however, the lines of weakness may extend completely around the opening tab 34, allowing its complete removal from the first outer sleeve wall panel 14 in the manner of a tear strip. A portion 39 of the opening tab 34 projects beyond the edge of the first outer sleeve wall panel 14 to facilitate gripping by a user.

The second and fourth wall panels 16, 20 of the outer sleeve 4 are also provided with removable tabs 38 defined by semi-circular lines of weakness 40.

The inner sleeve 6 comprises first, second, third and fourth inner sleeve wall panels 42, 44, 46, 48 hingedly connected about a second array of fourth, fifth and sixth parallel hinge lines 50, 52, 54. The fourth to sixth hinge lines 50, 52, 54 are parallel to the first to third hinge lines 22, 24, 26. A gluing strip 56 is hingedly attached to the first inner sleeve wall panel 42 about a further hinge line 58, which is parallel to the first to sixth hinge lines 22, 24, 26, 50, 52, 54.

An array of flaps 31 attached to one end of the inner sleeve wall panels 42, 44, 46, 48 define, upon erection, a closed end 60 of the inner sleeve 6. The opposite end 62 of the inner sleeve 6 is open. As can be seen in FIG. 2 and FIG. 3, for example, the open end 62 of the inner sleeve 6 is defined by sloping edges 64. This is not essential, but it may facilitate access to the contents of the inner sleeve 6 after opening.

The outer sleeve 4 and the inner sleeve 6 are connected by a connecting panel 70. The connecting panel 70 can be seen most clearly in FIG. 3.

The connecting panel 70 comprises a first sub-panel 72 which is hingedly connected to the fourth inner sleeve wall panel 48 of the inner sleeve 6 by means of a seventh hinge line 74 which is parallel to the first to sixth hinge lines 22, 24, 26, 50, 52, 54. The connecting panel 70 further comprises a second sub-panel 76 which is connected to fourth outer sleeve panel 20 by an eighth hinge line 78 which is parallel to the other aforementioned hinge lines. The first sub-panel 72 and second sub-panel 76 are separated by a cut-line 80 which is provided with a small bridge of material 82 to maintain the first and second sub panels 72, 76 in registry during assembly.

The upper edges 84 of the first and second flap forming panels 72, 76 are generally coplanar with the ends of the first to fourth outer sleeve wall panels 14, 16, 18, 20.

The first and second sub-panels 72, 76 are attached to a third sub panel 86 which is hingedly connected to the fourth outer sleeve wall panel 20 along the eighth hinge line 78 between the sub panel 76 and the fourth outer sleeve wall panel 20.

The third sub-panel 86 is provided with parallel lines of weakness 88 at one end thereof to define a removable tab 90 therebetween. As can be seen from FIG. 3, the tab 90 is aligned with the tab 34 defined in the first outer sleeve wall panel 14.

A flap 92 is hingedly attached to the third sub panel 86 about a ninth hinge line 94. A tenth hinge line 96 is provided at a distal end of the flap 92 to define a distal flap 98.

As will be described in further detail below the tab 90 defined in the connecting panel 70 provides a frangible connection between the inner and outer sleeves 6, 4. Also, the first sub-panel 72, and the flap 92 will form the releasable lock 12 between the outer sleeve 4 and inner sleeve 6.

The erection of the package will be described with reference to FIGS. 4 to 11.

Figure 4:
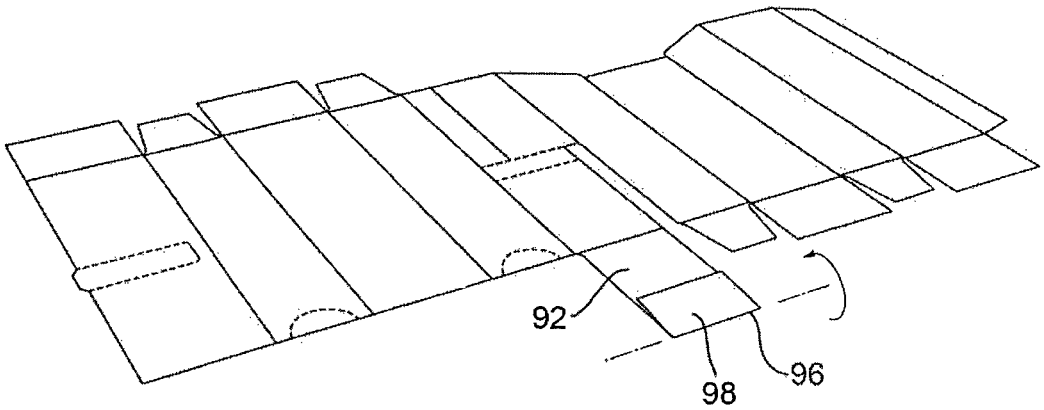
FIGS. 4 to 11 illustrate the steps of assembling the blank of FIG. 3 into the package of FIG. 1.
Figure 5:
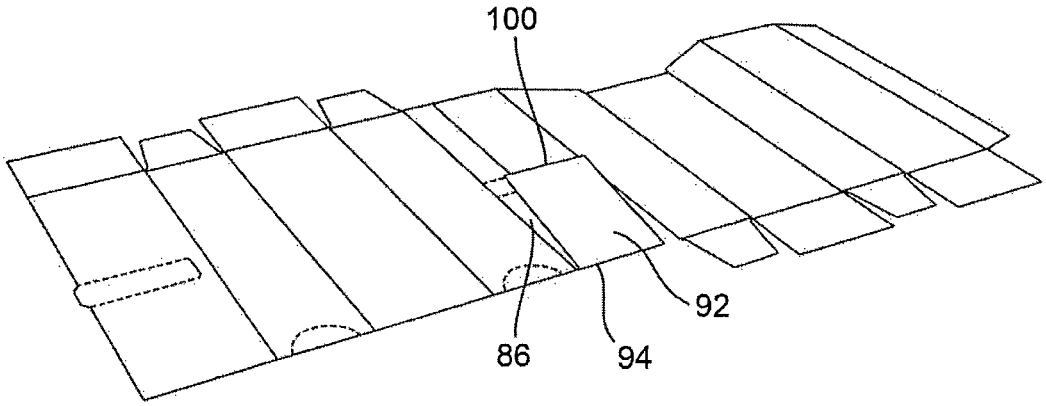

In the first step, illustrated in FIG. 4, the distal flap 98 is folded about the tenth hinge line 96 and glued to the flap 92.

In the second step, the flap 92 is folded about ninth tenth fold line 94 and glued down on the third sub-panel 86. As will be described further below, the tenth hinge line 96 will form a locking edge 100 of the releasable lock 12.

Figure 6:
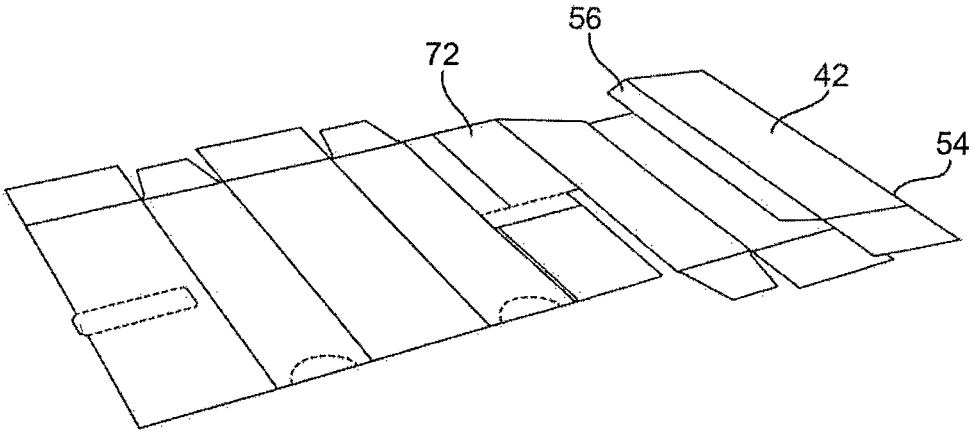
Figure 7:
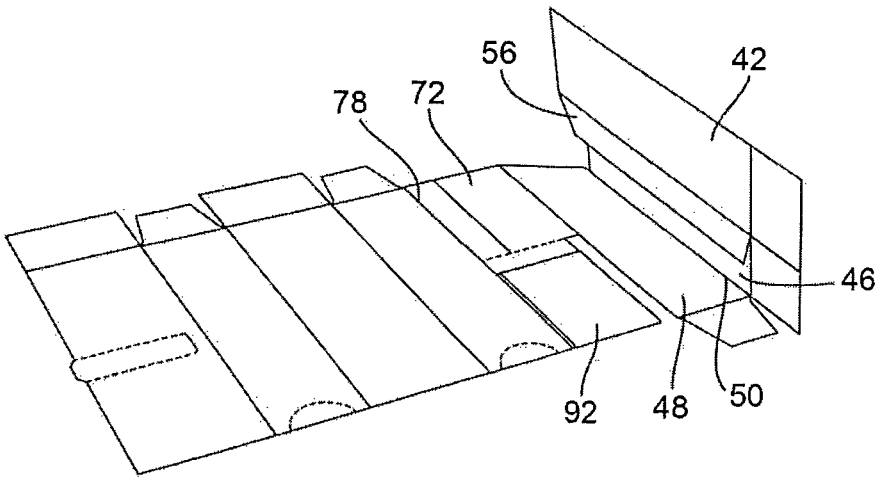

In the next stage of the process, the first inner sleeve wall panel 42 is folded about sixth hinge line 54 as illustrated in FIG. 6. Glue is then applied to the exposed surface of the gluing strip 56 and to the exposed surface of the first sub-panel 72 of the connecting panel 70.

The first, second and third inner sleeve wall panels 42, 44 and 46 are then folded together about fourth hinge line 50. In this way, the gluing strip 56 will be glued to the fourth inner sleeve wall panel 48, thereby creating the structure of the inner sleeve 6. Moreover, the first sub-panel 72 of the connecting panel 70 will be bonded to the first inner sleeve wall panel 42. Although the first inner sleeve wall panel 42 overlies the connecting panel flap 92, it is not bonded thereto.

Figure 8:
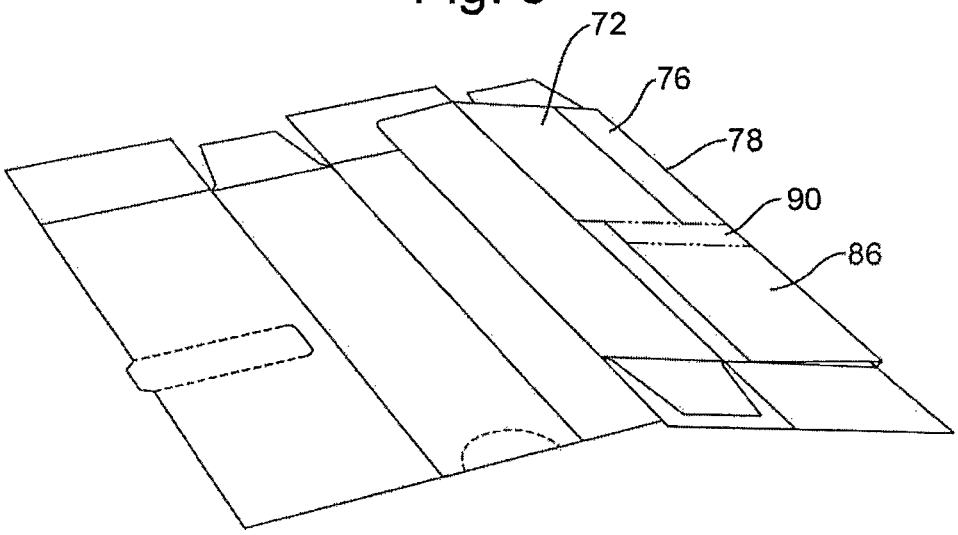
Figure 9:
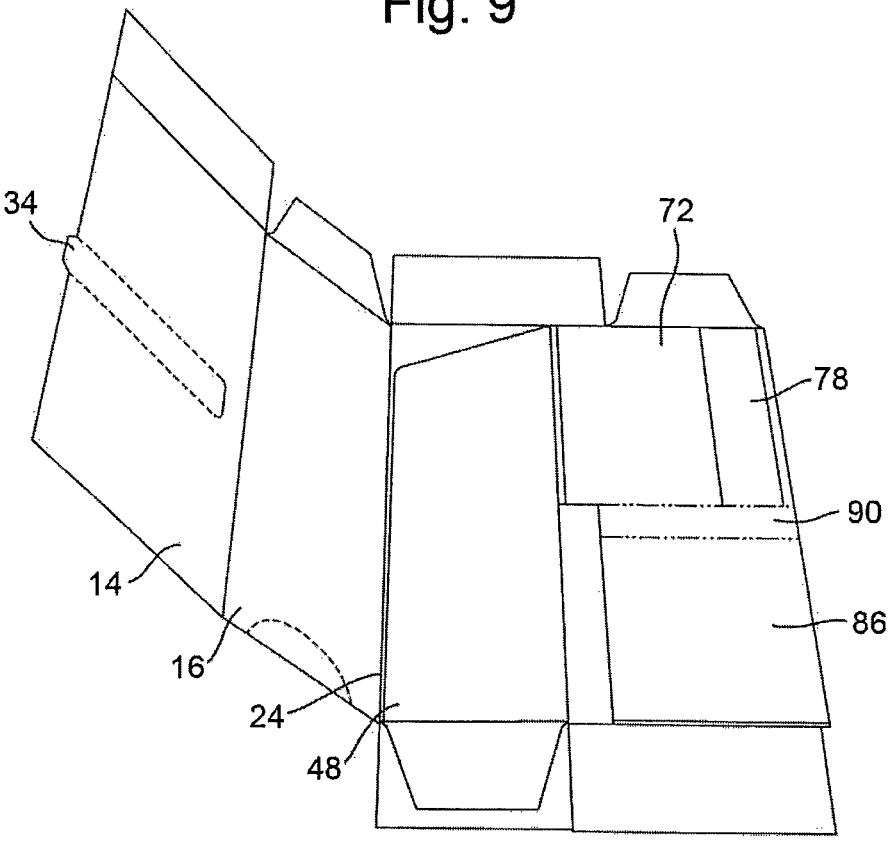
Figure 10:
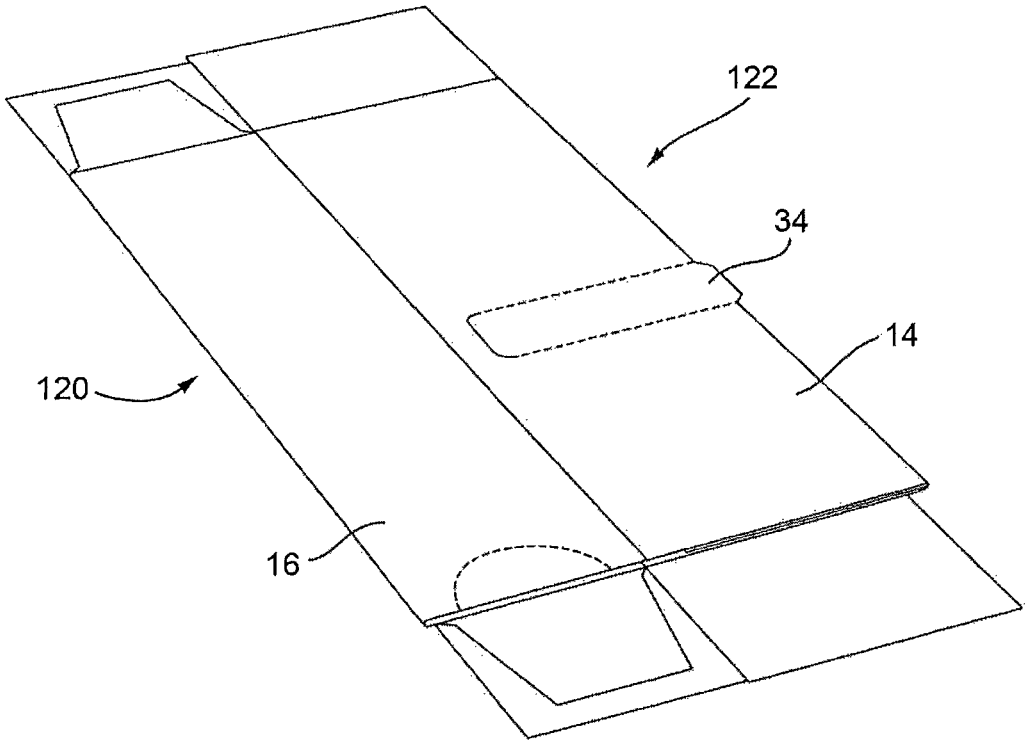

The inner sleeve panels 42, 44, 46, 48 and connecting panel 70 are then folded together about eighth hinge line 78 between the connecting panel 70 and the fourth outer sleeve wall panel 20 as illustrated in FIG. 8. In that position, adhesive is applied to the second and third sub-panels 76, 86 and the tab 90 of the connecting panel 70. Then, as illustrated in FIG. 9, the first and second outer sleeve wall panels 14, 16 are folded together about second hinge line 24 and pressed against the fourth inner sleeve wall panel 48 and the connecting panel 70. Since the sub-panels 76, 86 have had glue applied, they will adhere to the first outer sleeve wall panel 14. Moreover, the tab 90 of the connecting panel 70 will adhere to the opening tab 34 formed in the first outer sleeve wall panel 14. The package will then appear as in FIG. 10.

The package 2 may be conveniently supplied to a packer in this semi-erected configuration, as all that will need to be done is for the packer to finish erection of the package 2, insert the contents of the package 2 and then close the package 2. These operations will now be described below.

Figure 11:
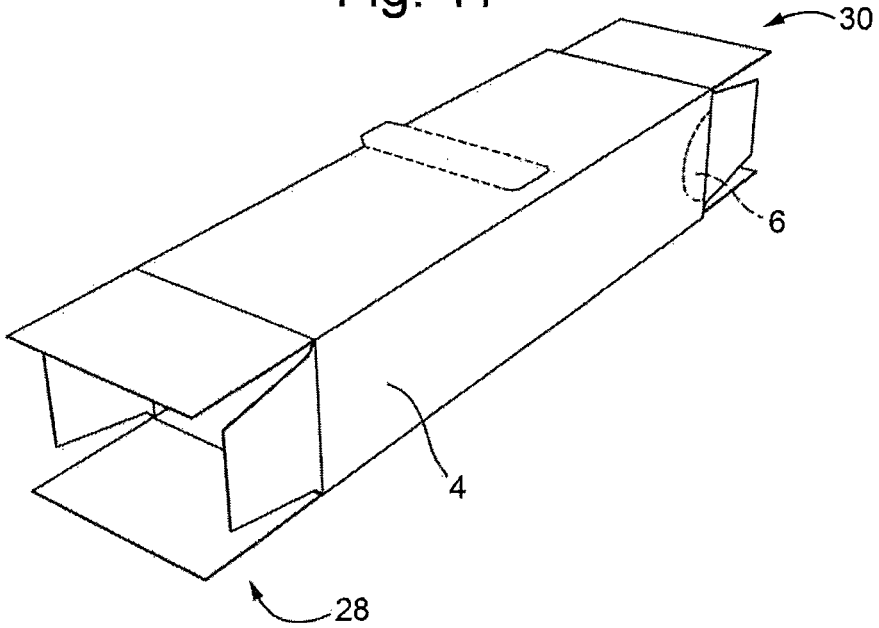
Figure 12:
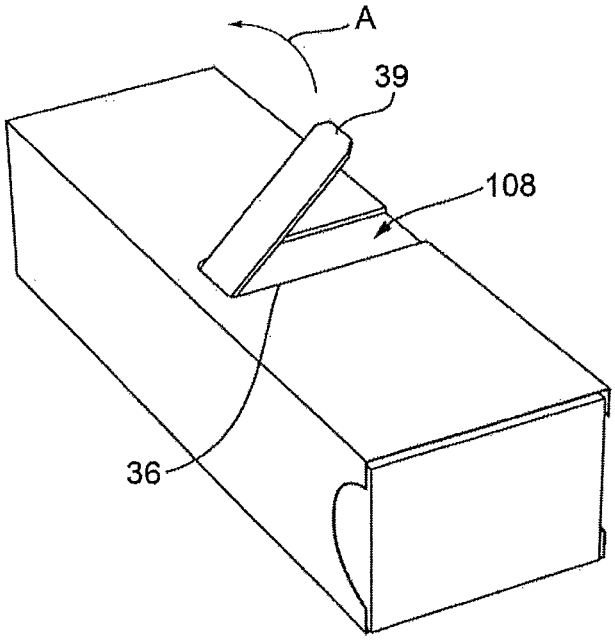
FIG. 12 shows the package of FIG. 1 being opened.
Figure 13:
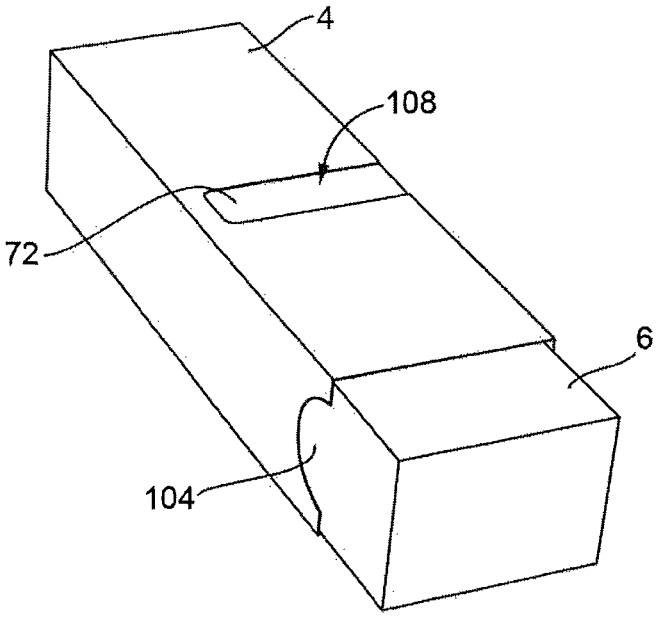
FIG. 13 shows a later stage in the opening of the package of FIG. 1.

To erect the package, the opposed edges 120, 122 of the semi-erected construction may then be pushed together to form a tubular construction as shown in FIG. 11. The closure flaps 31 of the inner sleeve 6 may then be folded over and glued to form the closed end 60 of the inner sleeve 6 and the product, for example a tube or bottle, then filled into the package 2 through the open end flaps 28 of the outer sleeve 4. These flaps 28 may then be closed to form the closed end 30 of the outer sleeve 4. The filled package 2 may then be shipped.

In the above condition, the package 2 is still a unitary construction having the inner sleeve 6 joined to the outer sleeve 4 by the connecting panel 70. In order to gain access to the contents of the package 2, several steps must be taken by a user.

As a first step, the tabs 38 formed at the open end 32 of the outer sleeve 4 must be torn away. Once these tabs 38 are torn away, a user will be able to grip the closed end of the inner sleeve 6. Without removing these tabs 38, it is not easily possible to grip the inner sleeve 6 for removal purposes. The tabs 38 therefore form a first level of child resistance.

Next, the frangible connection 10 between the outer sleeve 4 and inner sleeve 6 must be broken. This is effected by pulling upwardly on the opening tab 34 as illustrated by the arrow A in FIG. 1. Since the tab 34 is adhesively connected to the tab 90 in the underlying connecting panel 70, tearing the tab 34 will also break the lines of weakness 88 connecting the tab 90 in the connecting panel 70 to the connecting panel 70, thereby separating the first and second sub-panels 72, 76 from the third sub-panel 86 of the connecting panel 70. The first sub-panel 72 remains attached to the inner sleeve 6 by the eighth hinge line 74; however, the adjacent second sub-panel 76 is attached to the fourth outer sleeve wall panel 20 about ninth hinge line 78. The third sub-panel 86 also remains attached to the fourth outer wall panel 20 by means of the ninth hinge line 78. Thus, once the lines of weakness 88 are broken, the only connection between the inner and outer sleeves 4, 6 is the small bridge of material 82 between the first and second sub-panels 72, 76 and this can easily be broken by the initial pulling of the inner sleeve 6 from the outer sleeve 4. This mechanism provides a second level of child resistance.

Removal of the tab 90 from the connecting panel 70 leaves a free edge 102 at one end of the first sub-panel 72. This free edge 102 and the edge 100 of the third sub panel 86 formed by the eleventh hinge line 96, together form the releasable lock 12 for the package 2 as will be described further below. This mechanism constitutes a third level of child resistance.

In order to access the contents of the container 2, after the tab 34 has been opened, the user grips the closed end 32 of the inner sleeve 6 through the openings 104 left after removal of the tabs 38 from the outer sleeve 4 and pulls the inner sleeve 6 out from the open end 32 of the outer sleeve 4. This breaks the bridge of material 82 between the first and second sub-panels of the connecting panel 70.

However, the inner sleeve 6 can only move a limited distance before the edge 102 of the first sub-panel 72 engages the edge 100 of the third sub-panel 86. When this occurs, no further movement of the inner sleeve 6 out from the outer sleeve 4 is possible. In order to release this locking mechanism, the user must press downwardly on the area of the first sub panel 72 which is exposed through the opening 108 created by opening the tear tab 34. Pushing downwardly on the first sub-panel 72 disengages its free end 102 from the edge 100 of the panel 86, allowing the inner sleeve 6 then to be fully removed from the outer sleeve 4.

Thus, there are three child resistant features in the described package. First, the end tabs 38 of the outer sleeve 4 which must be removed to allow access to the inner sleeve 6 in order to pull it from the outer sleeve 4. Second, the tear tab 34 which must be released in order to break the connection between the inner sleeve 6 and the outer sleeve 4 and finally, the releasable lock 12 which must be released to allow the inner sleeve 6 to be fully removed from the outer sleeve 4 in order to access the contents of the inner sleeve 6.

After the contents have been used, they may be once more placed in the inner sleeve 6 and the inner sleeve then inserted back into the outer sleeve 4. The releasable lock 12 will then re-engage, preventing easy removal of the inner sleeve 6 from the outer sleeve 4.

These and other modifications are intended to fall within the scope of the invention as defined by the following claims.

The invention claimed is:

1. A child resistant package made from paperboard, cardboard or other foldable sheet material and comprising:

an outer sleeve having a closed end and an opposed open end;

an inner sleeve, telescopically received within the outer sleeve and having a closed end adjacent the open end of the outer sleeve, wherein said inner sleeve is joined to said outer sleeve by a frangible connection;

a selectively releasable lock between the inner sleeve and the outer sleeve for preventing withdrawal of the inner sleeve from the outer sleeve after the frangible connection between the inner sleeve and the outer sleeve has been broken; and an opening tab formed in the outer sleeve, the opening tab being configured to break the frangible connection between the inner and outer sleeves when the tab is released from the outer sleeve and to provide an opening in the outer sleeve to provide access to the inner sleeve such that the inner sleeve may be pressed inwardly in order to release the releasable lock between the inner and outer sleeves.

2. The child resistant package as claimed in claim 1, wherein said frangible connection between said inner and outer sleeves comprises one or more lines of weakness defined in a connecting panel which is attached to and arranged between said inner and outer sleeves.

3. The child resistant package as claimed in claim 2, wherein said one or more lines of weakness define a tab which underlies and which is bonded to the opening tab.

4. The child resistant package as claimed in claim 2, wherein said selectively releasable lock comprises a first locking element formed by a first sub-panel of said connecting panel and attached to said inner sleeve and a second locking element attached to said outer sleeve, said first locking element and said second locking element comprising opposing, interfering locking edges which engage to prevent withdrawal of the inner sleeve from the outer sleeve, the inward pressing of the inner sleeve permitting disengagement of the edges.

5. The child resistant package as claimed in claim 4, wherein said first sub-panel of said connecting panel is defined by a cut line which longitudinally divides a first end of the connecting panel into said first sub-panel and a second sub-panel for gluing to a wall panel of the outer sleeve.

6. The child resistant package as claimed in claim 4, wherein said second locking element comprises a flap hingedly attached to the connecting panel.

7. The child resistant package as claimed in claim 6, wherein the flap is hingedly attached to an end of the connecting panel at the open end of the outer sleeve and extends into the outer sleeve from the open end of the outer sleeve.

8. The child resistant package as claimed in claim 7, wherein the second locking element flap is bonded to an opposed sub-panel of the connecting panel.

9. The child resistant package as claimed in claim 6, wherein the flap has a double thickness edge.

10. The child resistant package as claimed in claim 9, wherein the double thickness edge is formed by a hinge line between the flap and a distal flap connected thereto.

11. The child resistant package as claimed in claim 1, wherein said opening tab is defined as a tear strip extending across a wall of the outer sleeve and is completely removable from the wall.

12. The child resistant package as claimed in claim 1, wherein said opening tab is defined as a tear strip extending across a wall of the outer sleeve and is hingedly attached at one end to the outer sleeve.

13. The child resistant package as claimed in claim 1, comprising removable tabs at the open end of the outer sleeve.

14. The child resistant package as claimed in claim 1, wherein the inner sleeve has an open end adjacent the closed end of the outer sleeve.

15. The child resistant package as claimed in claim 14, wherein the open end of the inner sleeve is angled.

16. The child resistant package as claimed in claim 1 made from a one-piece blank of foldable sheet material.

17. A one piece blank for forming a child resistant package as claimed in claim 1 comprising:

a row of first, second, third and fourth outer sleeve wall panels hingedly connected about first to third parallel hinge lines for forming the outer sleeve of the package;

a row of first, second, third and fourth inner sleeve wall panels hingedly connected about fourth to sixth parallel hinge lines for forming the inner sleeve of the package 2, said fourth to sixth hinge lines being parallel to said first to third hinge lines; and a connecting panel connected between said first row and second row of panels and hingedly connected to the fourth inner sleeve wall panel about a seventh hinge line which is parallel to the first to sixth hinge lines, and to the fourth outer sleeve wall panel about an eighth hinge line which is parallel to the first to sixth hinge lines, and having a flap hingedly connected to an end thereof about a ninth hinge line perpendicular to said first to sixth hinge lines;

wherein the connecting panel comprises a frangible connection between two parts thereof;

wherein the first outer sleeve panel comprises an opening tab defined therein, said opening tab being aligned with said frangible connection such as to overlie the frangible connection when the blank is erected.

18. The blank as claimed in claim 17, wherein the connecting panel comprises a first sub panel connected to the fourth inner sleeve wall panel about the seventh hinge line and a third sub-panel connected to the fourth outer sleeve wall panel about the eighth hinge line, the frangible connection being between the first and third sub-panels.

19. The blank as claimed in claim 18, wherein the frangible connection comprises a tab defined between lines of weakness.

20. The blank as claimed in claim 18, wherein the connecting panel further comprises a second sub-panel separated from the first sub-panel by a cut line and hingedly connected to the fourth outer sleeve wall panel about the eighth hinge line.

21. The blank as claimed in claim 19, comprising a frangible bridge of material between the first and second sub-panels.

22. The blank as claimed in claim 17, wherein the flap is formed with a distal flap connected to the flap about a tenth hinge line parallel to the ninth hinge line.

23. A partially erected blank formed from the blank of claim 18, in which the flap of the connecting panel has been folded about the ninth hinge line to overlie the third sub-panel of the connecting panel, comprising an inner shell portion comprising inner shell wall panels, with the first inner shell wall panel folded about the sixth hinge line to overlie the second inner wall panel, and the second and third inner shell wall panels folded about the fourth hinge line such that the second wall inner sleeve panel overlies the connecting panel and is bonded to the first sub-panel of the connecting panel, the inner sleeve wall panels and connecting panel folded about the eighth hinge line to overlie the third and fourth outer sleeve wall panels, and an outer shell portion comprising the outer shell wall panels with the first and second outer sleeve wall panels folded about the second hinge line to sandwich the inner sleeve wall panels and connecting panel between the first and second outer sleeve wall panels and the third and fourth outer sleeve wall panels, the first outer sleeve wall panel bonded to the flap of the connecting panel.

* * * * *